US007289116B2

(12) United States Patent
Tanaka

(10) Patent No.: US 7,289,116 B2
(45) Date of Patent: Oct. 30, 2007

(54) ELECTRIC POWER UNIT FOR DRIVING A DISPLAY AND A DISPLAY UTILIZING SUCH POWER UNIT

(75) Inventor: Toshimasa Tanaka, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 595 days.

(21) Appl. No.: 10/771,856

(22) Filed: Feb. 4, 2004

(65) Prior Publication Data

US 2004/0160436 A1 Aug. 19, 2004

(30) Foreign Application Priority Data

Feb. 13, 2003 (JP) ..... 2003-034677
Apr. 16, 2003 (JP) ..... 2003-111061

(51) Int. Cl.
*G09G 5/00* (2006.01)
*G09G 3/36* (2006.01)

(52) U.S. Cl. ..... 345/211; 345/87

(58) Field of Classification Search ..... 345/87, 345/89, 98, 100, 211
See application file for complete search history.

(56) References Cited

U.S. PATENT DOCUMENTS 6,326,959 B1 * 12/2001 Tanaka ..... 345/211
6,426,594 B1 * 7/2002 Ito ..... 315/169.1
6,597,119 B2 7/2003 Ito
6,909,413 B2 * 6/2005 Nanno et al. ..... 345/87
7,061,481 B2 * 6/2006 Tsuchiya ..... 345/211
7,126,595 B2 * 10/2006 Yanagi et al. ..... 345/211

FOREIGN PATENT DOCUMENTS

JP 08-271856 10/1996
JP 10-241388 9/1998
JP 2000-235173 8/2000

* cited by examiner

*Primary Examiner*—Jimmy H. Nguyen
(74) *Attorney, Agent, or Firm*—Hogan & Hartson LLP

(57) ABSTRACT

An electric power unit for driving a matrix-type display unit in alternating cycle mode has a multiplicity of buffer circuits for generating a multiplicity of high output voltages (high output voltage group) and a multiplicity of buffer circuits for generating a multiplicity of low output voltages (low output voltage group). A power supply voltage is stepped up by a first and a third voltage conversion circuits into a first and a third output supply voltages. The highest voltage of the high output voltage group is stepped down by a second voltage conversion circuit to output a predetermined second output power supply voltage. These first through third output power supply voltages are used as the operating voltages of the buffer circuits. Also, the power supply voltage is stepped up by the second voltage conversion circuit to generate the second output power supply voltage, which voltage is further stepped up by the first voltage conversion circuit to generate the first output power supply voltage.

8 Claims, 16 Drawing Sheets

ELECTRIC POWER UNIT FOR DRIVING A DISPLAY AND A DISPLAY UTILIZING SUCH POWER UNIT

FIELD OF THE INVENTION

This invention relates to an electric power unit suitable for driving a display such as a simple matrix-type LCD unit for example at low power consumption rate. The invention also relates to a display unit utilizing such electric power unit.

BACKGROUND OF THE INVENTION

A simple matrix-type liquid crystal display (LCD) unit having a plurality of striping row electrodes (common electrodes) and a plurality of column electrodes (segment electrode) that perpendicularly intersect the common electrodes is widely used as a means for displaying dot information on the LCD unit.

Such LCD unit is driven by a scanning voltage sequentially applied to the respective common electrodes thereof and a signal voltage applied to a multiplicity of segment electrodes simultaneously with the scanning voltage.

Each liquid crystal element is controlled to have a transmissivity determined by the effective scanning voltage, that is defined to be the average of the scanning voltages applied to each of the row electrodes once in one frame period. One frame of a desired image amounts to scanning over 1 frame period. This scanning enables displaying one picture frame of a desired image.

FIG. 15 shows a circuit diagram of a conventional electric power unit for driving an LCD unit. As shown in FIG. 15, the electric power unit generates, from a given power supply voltage Vcc (typically 3 V), a first output voltage V0 (15 V), a second output voltage V1 (13.5 V), a third output voltage V2 (12 V), a fourth output voltage V3 (3 V), a fifth output voltage V4 (1.5 V), and a sixth voltage V5 (e.g. 0 V or ground potential) serving as a reference voltage, and supplies them to the LCD unit. In what follows, voltages are referenced to the ground potential unless otherwise stated. The LCD unit includes a display panel, a common driver for sequentially scanning the common electrodes, and a segment driver for applying a signal voltage to the segment electrodes in synchronism with the scanning of the common electrodes.

A charge pump circuit CHP0 is supplied with the power supply voltage Vcc and a clock signal clk to generate at the output end thereof a supply voltage (hereinafter referred to as output supply voltage) Vout0 (18 V) by stepping up the power supply voltage Vcc to 6Vcc. A smoothing capacitor C0 is connected to the charge pump circuit CHP0.

The output voltage Vout0 of the power unit is supplied to a voltage amplifier A1 that amplifies a reference voltage Vref (2 V) n times (n=7.5) to form a first reference voltage V0*r* (15 V). The first reference voltage V0*r* is divided by resistors R0-R4 to generate a second reference voltage V1*r* (13.5 V), a third reference voltage V2*r* (12 V), a fourth reference voltage V3*r* (3 V), and a fifth reference voltage V4*r* (1.5 V).

The first through fifth reference voltages V0*r*-Vr4, respectively, are supplied to the first through fifth buffer circuit B0-B4, respectively, operating at the output voltage Vout0 and a first through a fifth output voltages V0-V4, respectively, having the same voltage as the respective reference voltages are outputted therefrom. The sixth voltage V5 is the ground potential.

Of the first through sixth output voltage V0-V5, respectively, the first, second, fifth and sixth output voltages V0, V1, V4, and V5, respectively, are supplied to the common driver, while the first, third, fourth and sixth output voltages V0, V2, V3, and V5, respectively, are supplied to the segment driver of the LCD panel. These voltages are selectively supplied in synchronism with the period of the LCD in alternating cycle. In what follows the operation of the power unit will be described for one period of the frame cycle of the LCD unit.

FIG. 16 shows waveforms of drive voltages applied to a specific common electrode COMj and segment electrode SEGk of the LCD panel having n common electrodes and m segment electrodes.

In odd frames, common electrodes COM1-COMn are sequentially scanned to sequentially select one common electrode COMj at a time, to which the first output voltage V0 is applied. Those common electrodes COM1-COMn not selected (excluding COMj) are supplied with the fifth output voltage V4. On the other hand, segment electrodes SEG1-SEGm are supplied with the fourth output voltage V3 or the sixth voltage V5 in accordance with the display signal associated with the common electrode selected.

In even frames, common electrodes COM1-COMn are sequentially scanned to select one common electrode COMj at a time, to which the sixth voltage V5 is supplied. Those common electrodes COM1-COMn not selected are supplied with the second output voltage V1. On the other hand, segment electrodes SEG1-SEGm are supplied with the first output voltage V0 or the third output voltage V2 in accord with the display signal associated with the selected common electrode.

Thus, under the alternating control of the common and segment electrodes, a picture associated with a given display signal is displayed on the LCD panel.

In this case, the buffer circuit B3 and B4 are energized by the voltage between the output power supply voltage Vout0 and the sixth voltage V5 (ground potential). As a consequence, the power P consumed in driving the LCD panel is given by $$P = V\text{out}0 \times I\text{out}$$

where Iout is the current provided to the LCD elements during charging and discharging thereof. Consequently, the power consumed by the LCD panel increases in proportion to the voltage Vout0 as the step-up multiplication factor of the charge pump circuit CHP0 increased (the multiplication factor of the CHP0 shown in FIG. 15 is 6).

On the other hand, unselected LCD pixels require a voltage as small as first through third output voltages V0-V2 or fourth through sixth output voltages V3-V5 in one frame of the alternating cycles even when the step-up multiplication factor is high as shown in FIG. 16. To take advantage of alternating driving of such LCD panel, not only the final output power supply voltage of the step-up circuit, intermediate step-up voltages appearing in the intermediate stages of the step-up circuit (such as a charge pump circuit and Cockcroft-Walton circuit) may be extracted for use as supply voltages (referred to as output supply voltages). For example, Japanese Patent Applications Laid Open JPA-2001-75536 and JPA-2001-4976 (documents 1 and 2) disclose step-up circuits adapted to utilize intermediate step-up voltages for minimization of the power consumption by a display panel in addition to the final output power supply voltage of the circuit.

However, in order to allow extraction of final and intermediate step-up voltages, the prior art step-up circuits of the cited references 1 and 2 are composed of multi-stage step-up units connected in series. In this arrangement, however, it is difficult to properly set up intermediate set-up voltages as required by a given display panel. Further, if the required intermediate voltages were set up in the step-up circuit, the levels of extracted voltages would fluctuate, so that it is still difficult to obtain the voltages correctly. Moreover, intermediate step-up stages could fail proper absorption of currents.

SUMMARY OF THE INVENTION

It is, therefore, an object of the invention to provide an electric power unit for alternately driving a display unit such as a matrix-type LCD panel in a stable condition with a reduced power. It is another object of the invention to provide a display unit utilizing such electric power unit.

In accordance with one aspect of the invention, there is provided an electric power unit for driving a display unit, the power unit having: a first voltage conversion circuit CHP1 for stepping up an inputted power supply voltage Vcc to generate a first output power supply voltage Vout1; a multiplicity of buffer circuits B0-B2 for generating, based on the first output power supply voltage Vout1, a group of high output voltages (referred to as high output voltage group) V0-V2 and a multiplicity of buffer circuits B3-B4 for generating, based on the first output power supply voltage Vout1, a group of low output voltages (referred to as low output voltage group) V3-V4, all of the output voltages being lower than the first output power supply voltage Vout1 in the order mentioned, the electric power unit comprising:

a second voltage conversion circuit CHP2 for stepping down the highest output voltage V0 of the high output voltage group to generate a second output power supply voltage Vout2 that is lower than the lowest output voltage V2 of the high output voltage group but higher than the highest output voltage V3 of the low output voltage group; and a third voltage conversion circuit CHP3 for stepping up the inputted power supply voltage Vcc to generate a third output power supply voltage Vout3 that is lower than the lowest output voltage V2 of the high output voltage group but higher than the highest output voltage V3 of the low output voltage group.

The buffer circuit B0 outputting the highest output voltage V0 of the high output voltage group may be energized by the first output power supply voltage Vout1. At least one of the buffer circuits B1 and B2 associated with the high output voltage group may be energized by the first output power supply voltage Vout1 or the first output voltage V0 and by the second output power supply voltage Vout2. At least one of the buffer circuits B3 and B4 associated with the low output voltage group may be energized by the third output power supply voltage Vout3 and a reference voltage Vgnd.

An electric power unit for driving a display unit in accordance with another aspect of the invention comprises: a multiplicity of buffer circuits B0-B2 for generating, based on a first output power supply voltage Vout1 higher than an inputted power supply voltage Vcc, a group of high output voltages (high output voltage group) V0-V2 and a multiplicity of buffer circuits B3-B4 for generating, based on the first output power supply voltage Vout1, a group of low output voltages (low output voltage group) V3-V4, the output voltages of the low and high output voltage groups being lower than the first output power supply voltage Vout1 in the order mentioned, the electric power unit comprising:

a first voltage conversion circuit CHP1A for generating the first output power supply voltage Vout1;

a second voltage conversion circuit CHP2A for stepping up the inputted power supply voltage Vcc to generate a constant second output power supply voltage Vout2 lower than the lowest output voltage V2 of the high output voltage group but higher than the highest output voltage V3 of the low output voltage group; and a third voltage conversion circuit CHP3A for stepping up the inputted power supply voltage Vcc to generate a third output power supply voltage Vout3 that is lower than the lowest output voltage V2 of the high output voltage group but higher than the highest output voltage V3 of the low output voltage group, wherein the first voltage conversion circuit CHP1A is adapted to generate the first output power supply voltage Vout1 by stepping up the second output power supply voltage Vout2.

The buffer circuit B0 outputting the highest output voltage V0 of the high output voltage group may be energized by the output power supply voltage Vout1. At least one of the buffer circuits B1 and B2 associated with the high output voltage group may be energized by the first output power supply voltage Vout1 or the first output voltage V0 and by the second output power supply voltage Vout2. At least one of the buffer circuits B3 and B4 associated with the low voltage group may be energized by the third output power supply voltage Vout3 and a reference voltage Vgnd.

A display unit of the invention is adapted to drive a common driver and a segment driver of a matrix-type display panel by an electric power unit of the invention as described above.

In accordance with one aspect of the invention, an electric power unit for driving a matrix-type display unit has not only a first voltage conversion circuit (e.g. first charge pump circuit), but also a second voltage conversion circuit (e.g. second charge pump circuit) and a third voltage conversion circuit (e.g. third charge pump circuit). The multiple buffer circuits are adapted to generate groups of high output voltages as well as low output voltages required for the alternating cycles of the LCD unit, thereby reducing the power consumption by the display unit while permitting stable operation of the display unit.

Furthermore, as shown in the first embodiment, the second voltage conversion circuit is adapted to form the second output power supply voltage by stepping down an output voltage belonging to the high output voltage group, so that the power consumption is effectively reduced.

Moreover, as shown in a second embodiment, the output voltage of the second voltage conversion circuit may be provided as the input voltage to the first voltage conversion circuit, so that the first voltage conversion circuit only performs additional stepping up of the inputted voltage as required by the buffer circuits associated with the high output voltage group. The currents that flow from the buffer circuits of the high output voltage group to the second voltage conversion circuit are supplied to the first voltage conversion circuit. This makes the power consumption by the second voltage conversion circuit negligibly small, thereby facilitating further reduction of the overall power consumption.

It is noted that since the output voltage of the second voltage conversion circuit may be controlled to a predetermined constant level, voltages required for the buffer circuits can be appropriately generated.

DETAILED DESCRIPTION OF THE PREFERRED EMBODIMENTS

An electric power unit for driving an LCD unit in accordance with the invention and a display unit utilizing such electric power unit will now be described in detail by way of example with reference to the accompanying drawings.

Figure 1:
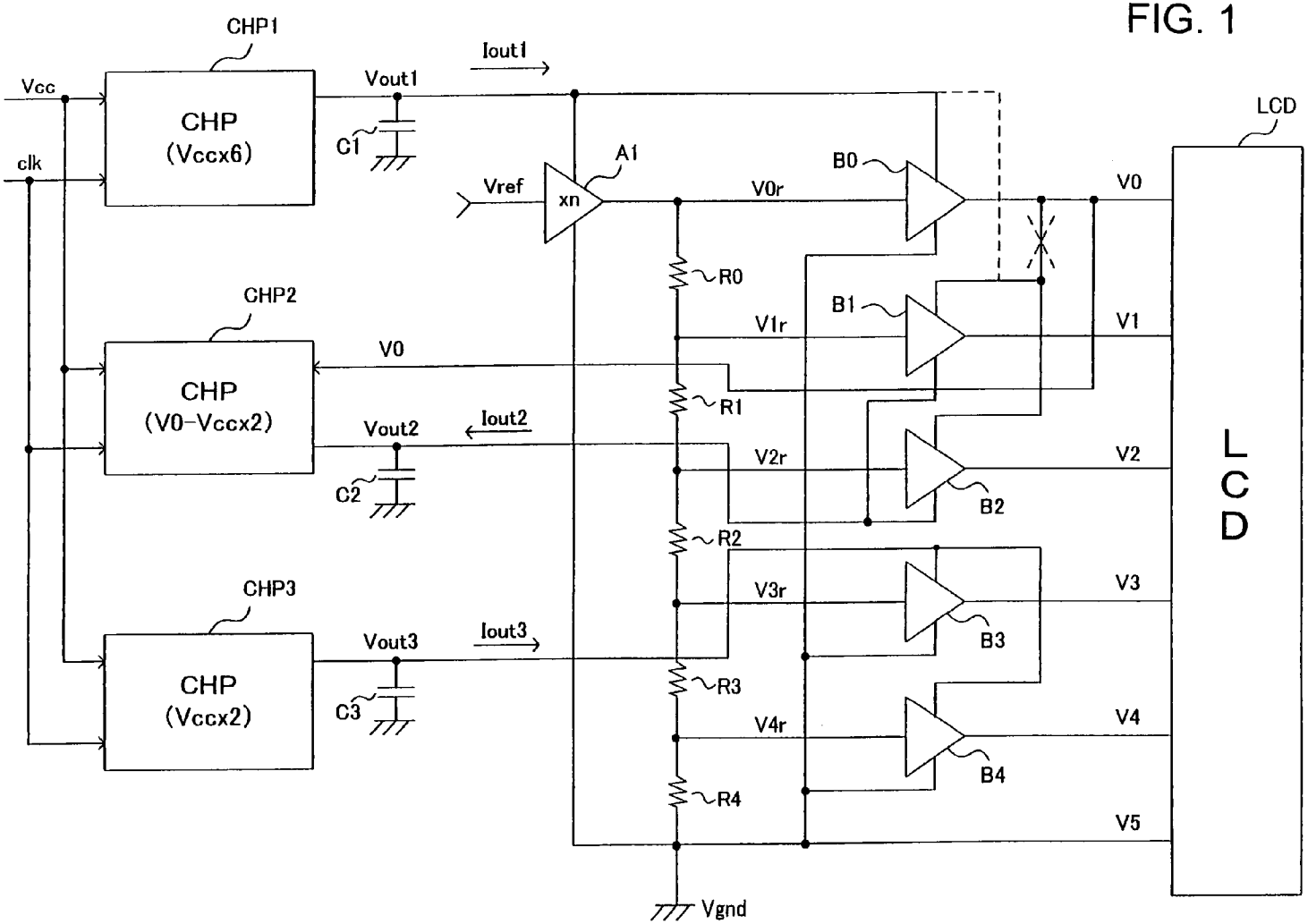
FIG. 1 is a circuit diagram of an electric power unit for driving an LCD unit in accordance with one embodiment of the invention.
Figure 2A:
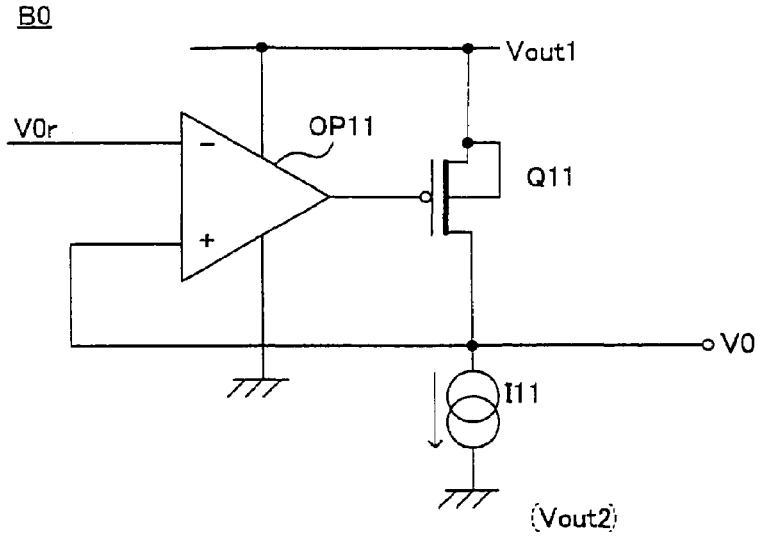
FIGS. 2A-2C are first through third buffer circuits B0-B2, respectively, according to the invention.
Figure 2B:
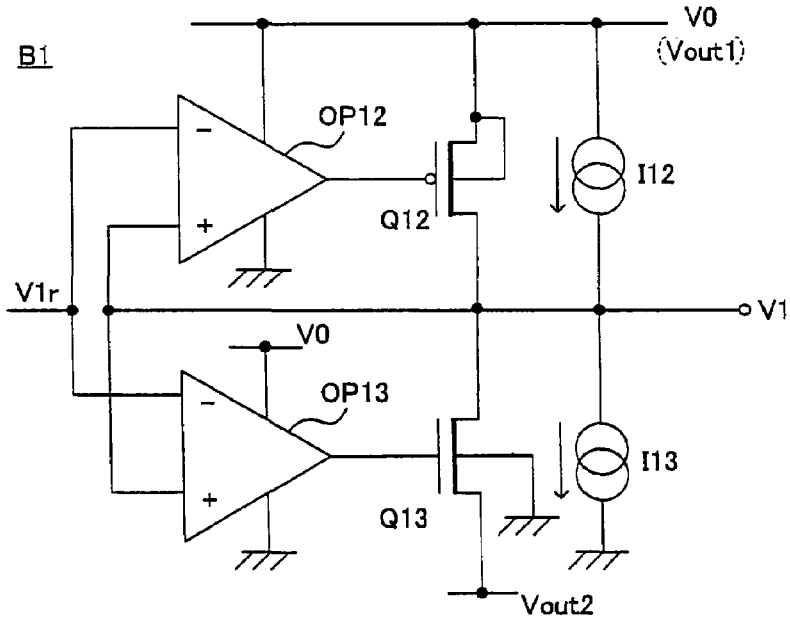
Figure 2C:
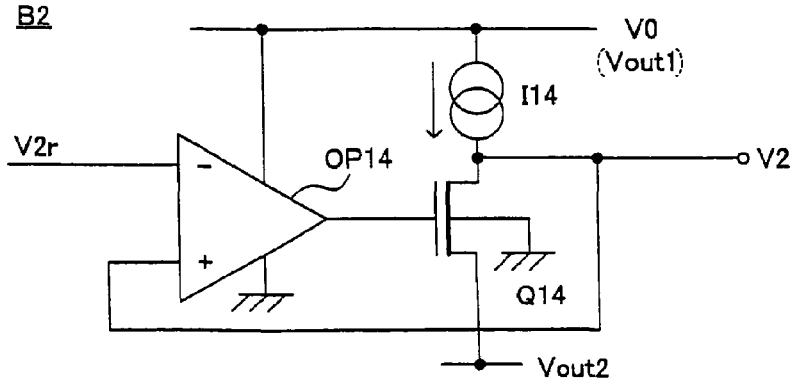
Figure 3A:
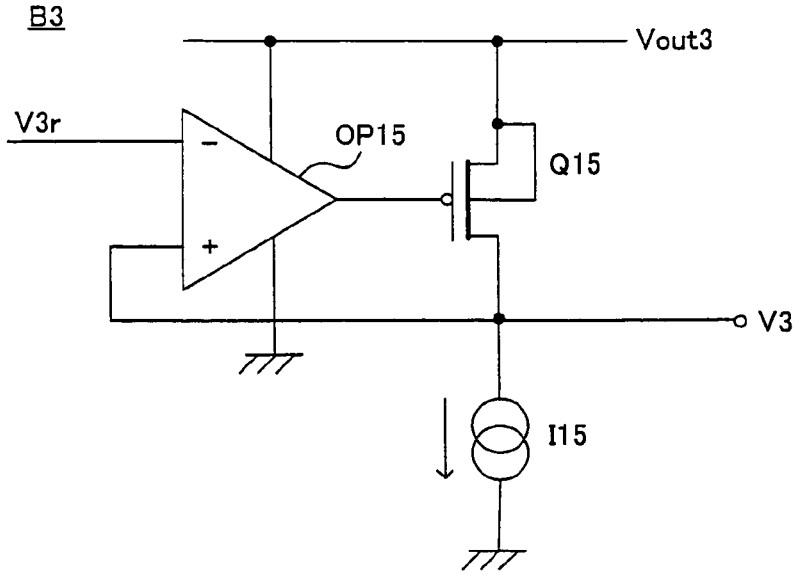
FIGS. 3A and 3B are circuit diagrams of a fourth and a fifth buffer circuits B3 and B4, respectively, according to the invention.
Figure 3B:
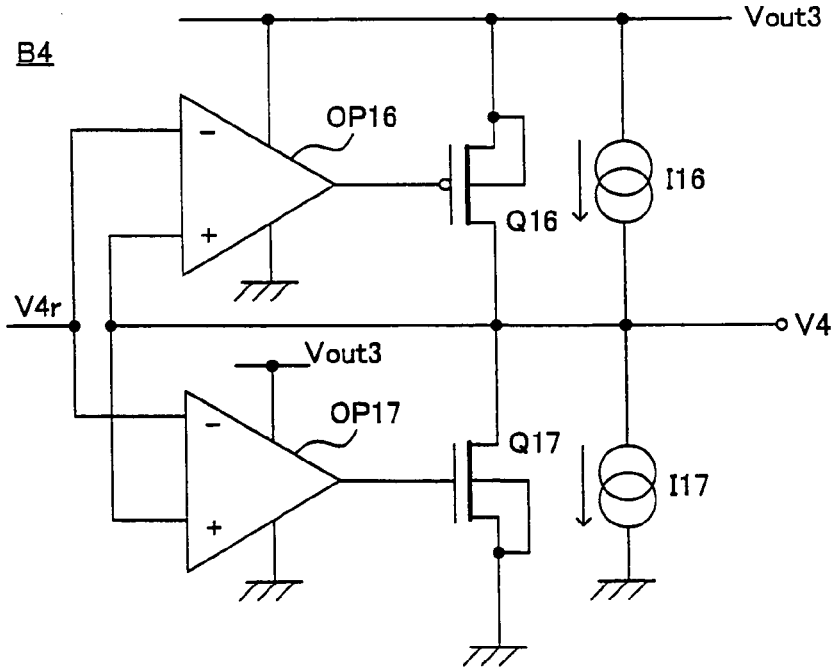

FIG. 1 shows a circuit diagram of an electric power unit for driving an LCD unit in accordance with one embodiment of the invention. FIGS. 2A-2C show buffer circuits B0-B2 of the high output voltage group for use in the invention. FIGS. 3A and 3B show circuit diagrams of buffer circuits B3-B4 of a low output voltage group for use in the invention. FIGS. 4-9 show circuit diagrams of voltage conversion circuits in the form of charge pump circuits CHP1-CHP3 in accordance with a first embodiment of the invention.

Figure 15:
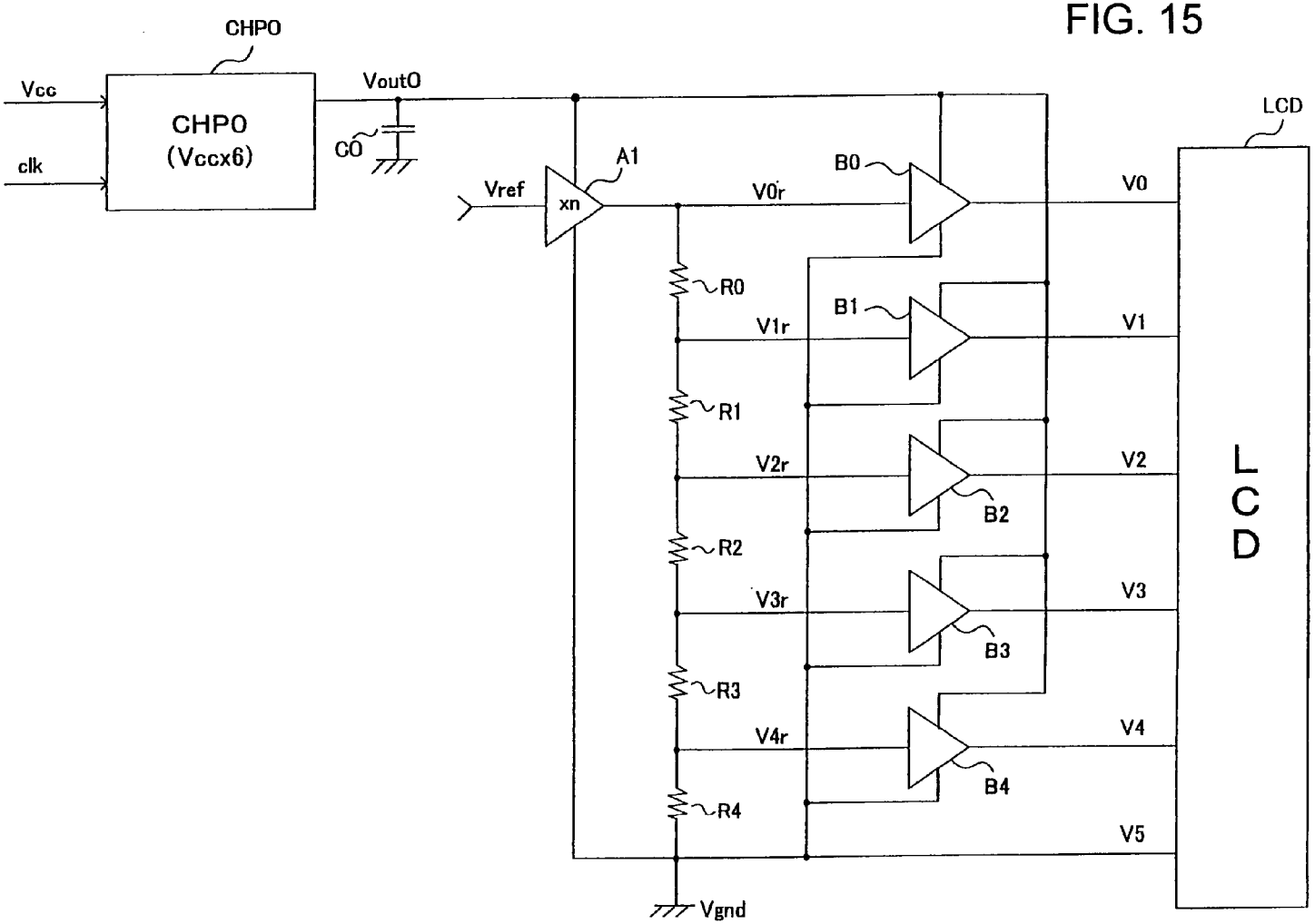
FIG. 15 PRIOR ART
FIG. 15 is a circuit diagram of a conventional electric power unit for driving an LCD unit.

As shown in FIG. 1, the invention provides the second and third charge pump circuits CHP2 and CHP3, respectively, in addition to the first charge pump circuit CHP1 used in a conventional voltage conversion circuit as shown in FIG. 15. It is noted that the operating voltages applied to the respective buffer circuits B1-B4 differ from those of FIG. 15. FIG. 1 is the same as FIG. 15 for rest of the circuit.

The first charge pump circuit CHP1 is supplied with a power supply voltage Vcc and a clock signal clk, and generates a first output power supply voltage Vout1 (18 V) obtained by stepping up the power supply voltage Vcc by a factor of 6. A capacitor C1 is a smoothing capacitor.

The first output power supply voltage Vout1 is supplied to a voltage amplifier A1 to generate a first reference voltage V0*r* (15 V) by amplifying a reference voltage Vref (2 V) by a factor of n (n=7.5). The first reference voltage V0*r* is divided by resistors R0-R4 to generate a second reference voltage V1*r* (13.5 V), a third reference voltage V2*r* (12 V), a fourth reference voltage V3*r* (3 V), and a fifth reference voltage V4*r* (1.5 V). The first output power supply voltage Vout1 is used to energize the first buffer circuit B0. The charge pump circuits are adapted to output operating voltages from the output ends of the buffer circuits and to absorb currents to the output ends of the buffers.

The second charge pump circuit CHP2 is supplied with the first output voltage V0 (15 V) and outputs a second output power supply voltage Vout2 (9 V), which is lower than the third output voltage V2 (12 V) but higher than the fourth output voltage V3 (3 V). In order to perform the charge pump operation, the clock signal clk is entered in the charge pump along with the power supply voltage Vcc that determines the level of the clock. The second output power supply voltage Vout2 turns out to be V0-Vcc×2. Capacitor C2 is a smoothing capacitor.

The third charge pump circuit CHP3 is supplied with the power supply voltage Vcc (3 V), and outputs a third output power supply voltage Vout3 (6 V), which is lower than the second output power supply voltage Vout2 (9 V) but higher than the fourth output voltage V3 (3 V). Capacitor C2 is also a smoothing capacitor.

The second and third buffer circuits B1 and B2, respectively, are energized by the first output voltage V0 and the second output power supply voltage Vout2, respectively. The fourth and fifth buffer circuits B3 and B4, respectively, are energized by the third and sixth output power supply voltages Vout3 and V5, respectively.

It is noted that since these voltages supplied to the buffer circuits B1-B4 fully cover the voltage amplitudes (V0-V2 or V3-V5) required in any phase of the alternating cycles of the LCD unit, they ensure secure operations of the LCD unit. It should be appreciated that the buffer circuits B0-B4 can sustain stabile operation as their operating voltages are provided by the first through third charge pump circuits CHP1-CHP3.

FIG. 2A shows an arrangement of the first buffer circuit B0. This buffer circuit B0 has a P-type first MOS transistor Q11 connected between nodes of the first output power supply voltage Vout1 and the first output voltage V0, and a constant-current generator I11 supplying a weak current (1 μA for example) connected between a node of the first output voltage V0 and the ground. The constant-current generator I11 stabilizes the buffer circuit. Similar constant-current sources are used in other buffer circuits for the same purpose. The electric power unit of the invention comprises a first operational amplifier OP11 energized by the first reference voltage V0*r* and the first output voltage V0 to output a control signal to a first MOS transistor Q11. A current flows from the first buffer circuit B0 via the first MOS transistor Q11 thereof, whereas the firs MOS transistor Q11 is controlled such that the first output voltage V0 becomes equal to the first reference voltage V0*r*. The first output power supply voltage Vout1 is used as the operating voltage of the first buffer circuit B0. It is noted that the constant-current source I11 may be provided between nodes of the first output voltage V0 and the second output power supply voltage Vout2.

FIG. 2B shows an arrangement of the second buffer circuit B1. The second buffer circuit B1 has a P-type second MOS transistor Q12 and an N-type third transistor Q13 connected in series between nodes of the first output voltage V0 and the second output power supply voltage Vout2, outputting a second output voltage V1 from the node of these series transistors. Current sources I12 and I13 provide constant currents. The second buffer circuit B1 has a second operational amplifier OP12 that receives the second reference voltage V1*r* and the second output voltage V1 and outputs a control signal to the second MOS transistor Q12, and a third operational amplifier OP13 that receives the second reference voltage V1*r* and the second output voltage V1 to output a control signal to a third MOS transistor Q13. A current flows out of the second buffer circuit B1 via the second MOS transistor Q12 thereof and flows in via the third MOS transistor Q13 thereof, whereas the transistor Q12 and Q13 are controlled such that the second output voltage V1 becomes equal to the second reference voltage V1*r*. Either one of the first output voltage V0 and the first output power supply voltage Vout1 together with the second output power supply voltage Vout2 is used to provide the operating voltage of the second buffer circuit B1.

FIG. 2C shows a third buffer circuit B2, which has a constant-current source I14 and an N-type fourth MOS transistor Q14 that is connected between nodes of the intermediate third output voltage V2 and the second output power supply voltage Vout2. The buffer circuit has a fourth operational amplifier OP14 that receives the third reference voltage V2*r* and the third output voltage V2 to output a control signal to the fourth MOS transistor Q14. A current flows out of the third buffer circuit B2 via the fourth MOS transistor Q14 thereof, whereas the fourth MOS transistor Q14 is controlled such that the third output voltage V2 becomes equal to the third reference voltage V2*r*.The second output power supply voltage Vout2 is used as the operating voltage of the third buffer circuit B2.

FIG. 3A is a circuit diagram of a fourth buffer circuit B3. The fourth buffer circuit B3 shown in FIG. 3A has a constant-current source I15 and a P-type fifth MOS transistor Q15 connected between nodes of the third output power supply voltage Vout3 and the intermediate fourth output voltage V3. The fourth buffer circuit B3 has a fifth operational amplifier OP15 that receives the fourth reference voltage V3*r* and the fourth output voltage V3 to output a control signal to the fifth MOS transistor Q15. A current flows out of the fourth buffer circuit B3 via the fifth MOS transistor Q14 thereof, whereas the fifth MOS transistor Q15 is controlled such that the fourth output voltage V3 becomes equal to the fourth reference voltage V3*r*.The third output power supply voltage Vout3 is used as the operating voltage of the fourth buffer circuit B3.

The fifth buffer circuit B4 shown in FIG. 3B has a P-type sixth MOS transistor Q16 and an N-type seventh transistor Q17 connected in series between nodes of the third output power supply voltage Vout3 and the sixth voltage V5 (ground potential) and constant-current sources I16 and I17, and provides the fifth intermediate output voltage V4 at the node of the sixth and seventh transistors. The buffer circuit B4 has a sixth operational amplifier OP16 that receives the fifth reference voltage V4*r* and the fifth output voltage V4 to output a control signal to the sixth MOS transistor Q16. The fifth buffer circuit B4 also has a seventh operational amplifier OP17 that receives a fifth reference voltage V4*r* and the fifth output voltage V4 to output a control signal to the seventh MOS transistor Q17. A current flows out of the fifth buffer circuit B4 via the sixth MOS transistor Q16 thereof and flows into the fifth buffer circuit B4 via the seventh MOS transistor Q17 thereof, whereas the sixth and seventh MOS transistors Q16 and Q17 are controlled such that the fifth output voltage V4 becomes equal to the fifth reference voltage V4*r*. The third output voltage Vout3 and the sixth voltage V5 are used as the operating voltage of the fifth buffer circuit B4.

Figure 4:
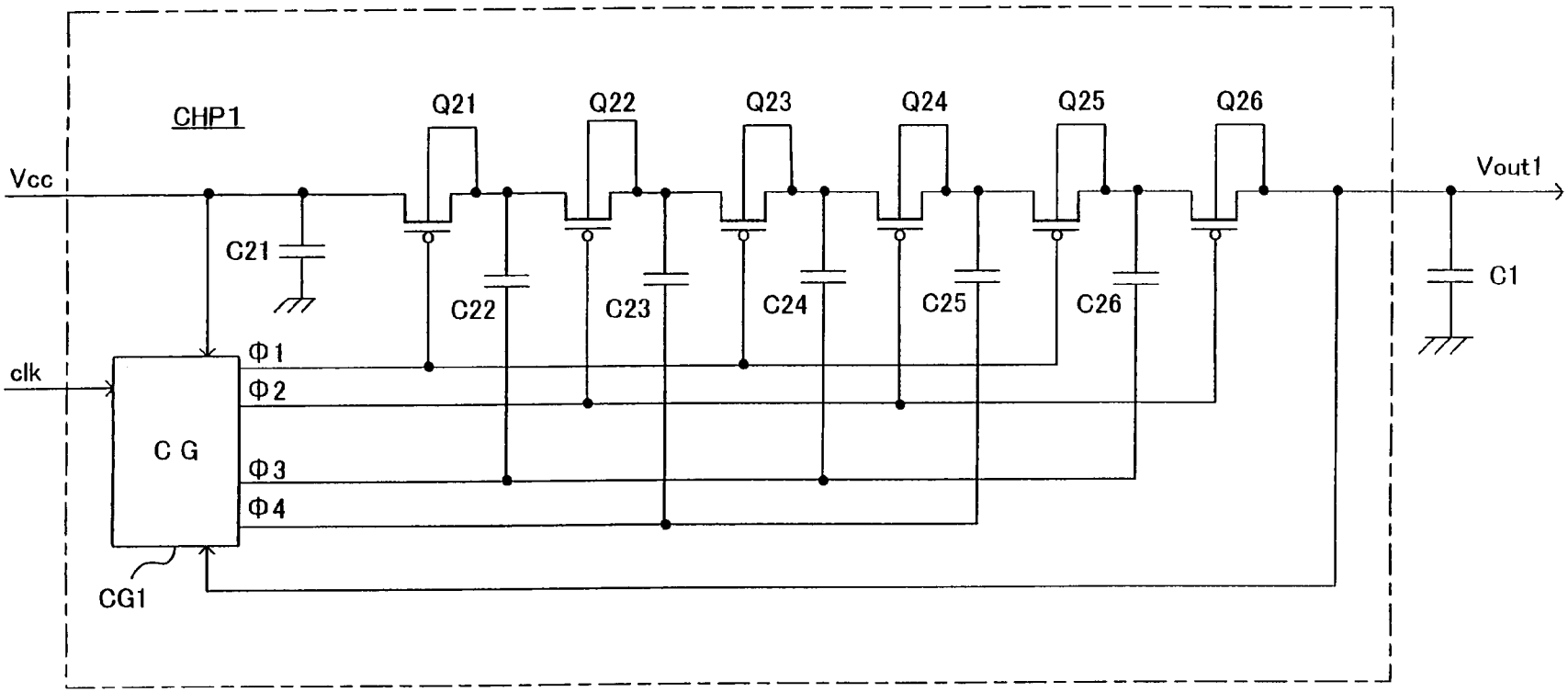
FIG. 4 is a circuit diagram of a first charge pump circuit CHP1 for use in the power unit according to the invention.
Figure 5:
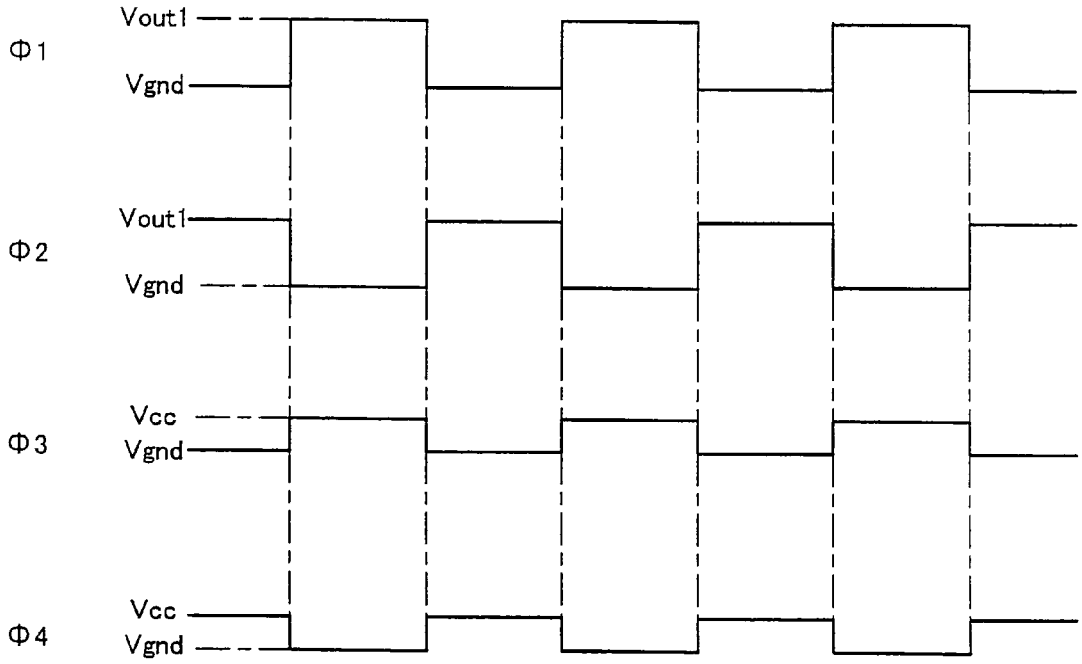
FIG. 5 is a graph showing the operation of the first charge pump circuit CHP1.

FIG. 4 and FIG. 5 respectively show the arrangement and operation of the first charge pump circuit CHP1. As shown in FIG. 4, the charge pump circuit CHP1 has P-type MOS transistors Q21-Q26 connected in series, to which the power supply voltage Vcc is supplied at the input end thereof. Each of the MOS transistors Q21-Q26 is connected at the input end thereof to one end of a corresponding one of capacitors C21-C26. The other end of the capacitor C21 is connected to the ground, while the other ends of the capacitors C22-C26 are connected to either one of two-phase clocks $\phi 3$ and $\phi 4$. The first output power supply voltage Vout1 is outputted from the output end of the first charge pump circuit CHP1, and so is the first output current Iout1.

A clock generator CG1 receives the clock signal clk, the power supply voltage Vcc, and the first output power supply voltage Vout1, and generates synchronized first through fourth clocks $\phi 1$-$\phi 4$, as shown in FIG. 5. The first and second clocks $\phi 1$ and $\phi 2$, respectively, are complementary two-phase clocks, varying between the ground potential Vgnd and the first output power supply voltage Vout1. In order to control ON-OFF operations of the MOS transistors Q21-Q26, the first clock $\phi 1$ is supplied to the gates of the odd numbered MOS transistors Q21, Q23, and Q25, while the second clock $\phi 2$ is supplied to the gates of the even numbered MOS transistors Q22, Q24, and Q26.

The third and fourth clocks $\phi 3$ and $\phi 4$, respectively, are also complementary two-phase clocks, varying between the ground potential Vgnd and the power supply voltage Vcc. The third clock $\phi 3$ is supplied to the other ends of the even numbered capacitors C22, C24, and C26, while the fourth clock $\phi 4$ is supplied to the other ends of the odd numbered capacitors C23 and C25. The step-up voltage of the respective charge pump unit is given by the amplitudes (Vcc-Vgnd) of the third and fourth clocks $\phi 3$ and $\phi 4$.

Figure 6:
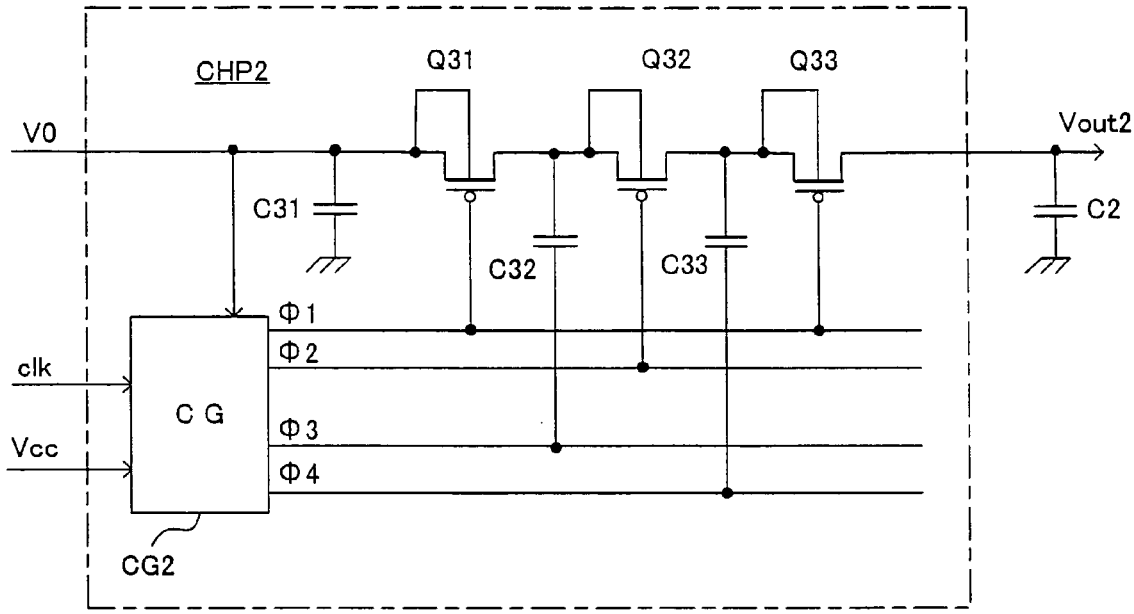
FIG. 6 is a circuit diagram of a second charge pump circuit CHP2 for use in the power unit according to the invention.
Figure 7:
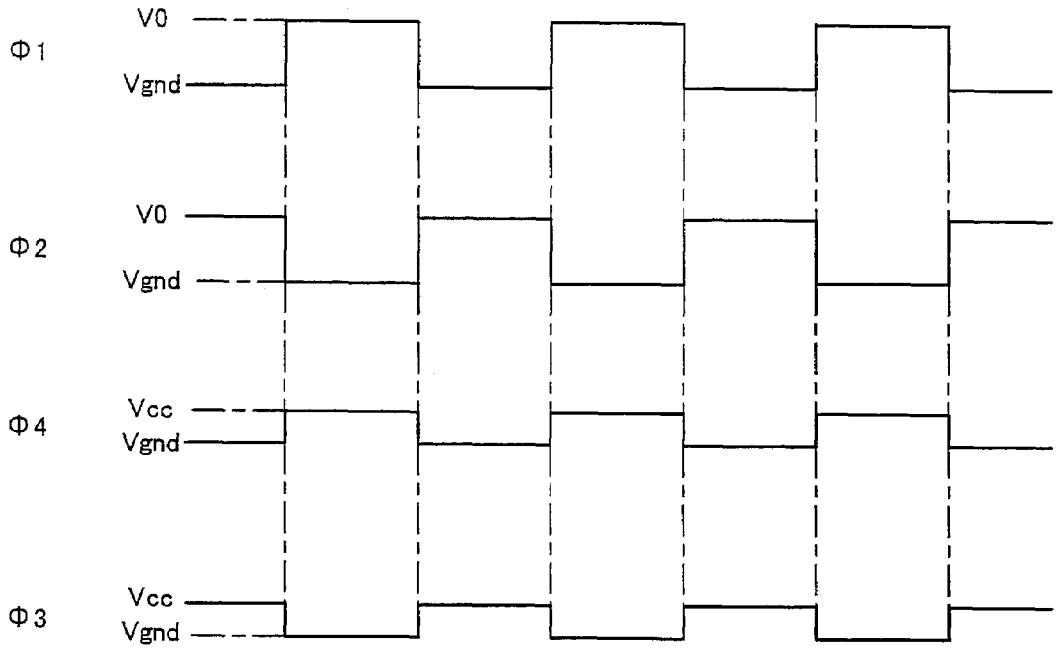
FIG. 7 is a graph showing the operation of the second charge pump circuit CHP2.

FIGS. 6 and 7 respectively show the arrangement and operation of the second charge pump circuit CHP2. As shown in FIG. 6, the charge pump circuit CHP2 has P-type MOS transistors Q31-Q33 connected in series, to which the first output voltage V0 is supplied at the input end thereof. Each of the MOS transistors Q31-Q33 is connected at the input end thereof to one end of a corresponding one of capacitors C31-C33. The other end of the capacitor C31 is connected to the ground, and the other ends of the capacitors C32 and C33 are respectively coupled to the two-phase clocks $\phi 3$ and $\phi 4$. The charge pump circuit CHP2 is supplied with the second output current Iout2 and outputs the second output power supply voltage Vout2 at the output end thereof.

The second charge pump circuit CHP2 performs step-down operation, due to the fact that the second output power supply voltage Vout2 (=V0−Vcc×2) is lower than the first output voltage V0. The first output voltage V0 supplied to the second charge pump circuit CHP2 may be replaced by the first output power supply voltage Vout1. In addition, the first and second clocks $\phi 1$ and $\phi 2$, respectively, may be varied between the ground potential Vgnd and the first output power supply voltage Vout1. In this instance, the clock generator CG2 may be supplied with the first output power supply voltage Vout1.

The clock generator CG2 of the second charge pump circuit CHP2 is supplied with the clock signal clk, the power supply voltage Vcc for determining the magnitude of a step-up voltage, and the first output voltage V0, and outputs synchronized first through fourth clocks $\phi 1$-$\phi 4$ as shown in FIG. 7. The first and second clocks $\phi 1$ and $\phi 2$, respectively, are complementary two-phase clocks, varying between the ground potential Vgnd and the first output voltage V0. In order to control ON-OFF operations of these transistors, the first clock ϕ1 is supplied to the gates of the odd numbered MOS transistors Q31 and Q33, while the second clock ϕ2 is supplied to the gate of the even numbered MOS transistor Q32.

The third and fourth clocks clock ϕ3 and ϕ4, respectively, are also complementary two-phase clocks, varying between the ground potential Vgnd and the power supply voltage Vcc. The third clock ϕ3 is supplied to the other end of the even numbered capacitor C32, while the fourth clock ϕ4 is supplied to the other end of the odd numbered capacitor C33. The step-up/down voltage of the respective charge pump unit is given by the amplitudes (Vcc-Vgnd) of the third and fourth clocks ϕ3 and ϕ4.

Current that flows out of the second and third buffer circuits B1 and B2, respectively, flows into the capacitor C2 connected to the output end of the second charge pump circuit CHP2. When the voltage across the capacitor C2 exceeds the predetermined level (9 V) of the second output power supply voltage Vout2 due to this current, the charge pump circuit CHP2 performs a step-up operation. The energy stored in the capacitor C2 is then fed back to the input end of the charge pump circuit CHP2.

Figure 8:
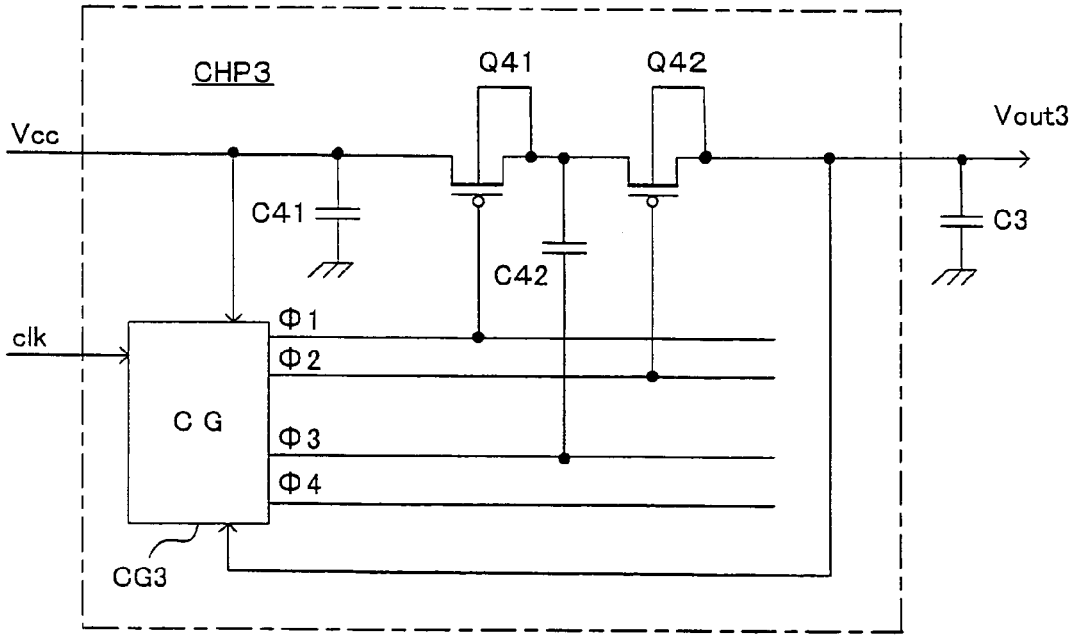
FIG. 8 is a circuit diagram of a third charge pump circuit CHP3 for use in the power unit according to the invention.
Figure 9:
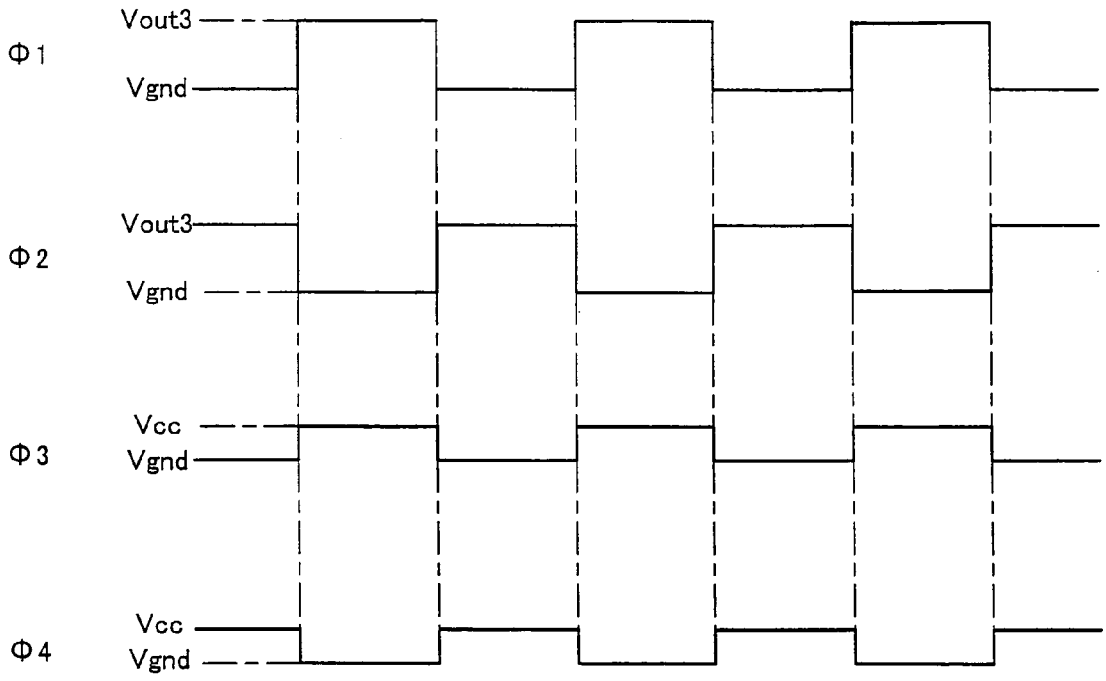
FIG. 9 is a graph showing the operation of the third charge pump circuit CHP3.

FIGS. 8 and 9 respectively show an arrangement and operation of the charge pump circuit CHP3, which includes a clock generator CG3, MOS transistors Q41 and Q42, and capacitors C41 and C42. The clock generator CG3 is supplied with the clock signal clk, power supply voltage Vcc, and third output power supply voltage Vout3, and generates synchronized first through fourth clocks ϕ1-ϕ4 as shown in FIG. 9. However, since the charge pump circuit CHP3 has only two step-up stages, the fourth clock ϕ4 is not used. The first and second clocks ϕ1 and ϕ2, respectively, are complementary two-phase clocks, varying between the ground potential Vgnd and the third output power supply voltage Vout3. As shown in FIG. 8, the P-type MOS transistors Q41 and Q42 are connected in series, to which the power supply voltage Vcc is supplied at the input end thereof. Each of the MOS transistors Q41 and Q42 is connected at the input end thereof to one end of a corresponding one of the capacitors C41 and C42. The other end of the capacitor C41 is connected to the ground, and the other end of the capacitor C42 is connected to the two-phase clock ϕ3. The first clock ϕ1 is supplied to the gate of the odd numbered MOS transistor Q41 while the second clock ϕ2 is supplied to the gate of the even numbered MOS transistor Q42, to thereby control ON-OFF operations of the respective transistors. The charge pump circuit CHP3 provides at the output end thereof the third output power supply voltage Vout3 and the third output current Iout3.

The third and fourth clocks ϕ3 and ϕ4, respectively, are also complementary two-phase clocks, varying between the ground potential Vgnd and the power supply voltage Vcc. The third clock ϕ3 is supplied to the other end of the even numbered capacitor C42. The step-up voltage of the respective charge pump unit is given by the amplitudes (Vcc-Vgnd) of the third and fourth clocks ϕ3 and ϕ4.

Figure 16:
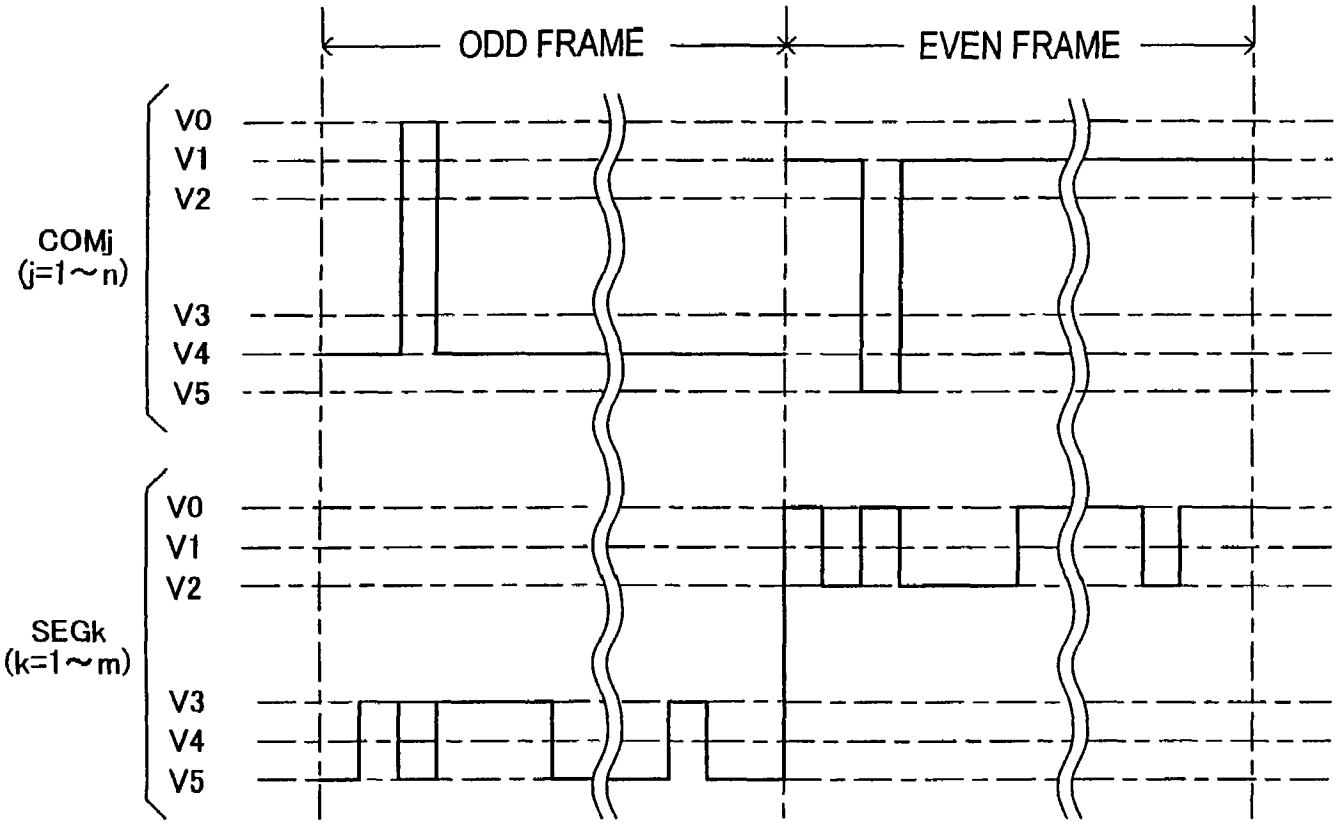
FIG. 16 is a graph showing voltage waveforms for driving an LCD unit.

Referring to FIG. 16, operation of the electric power unit for driving an LCD unit in accordance with the first embodiment of the invention will now be described.

In odd frames, the first output voltage V0 is applied to the common electrode COMj selected during scanning of the LCD unit, and the fifth output voltage V4 is applied to the common electrodes COM1-COMn (excluding COMj) not selected. On the other hand, the fourth output voltage V3 or the sixth voltage V5 is applied to the segment electrodes SEG1-SEGm in accord with the display signal supplied to the selected common electrode.

Thus, a large voltage between the first output voltage V0 and the fourth output voltage V3 or the sixth voltage V5 is applied to the LCD pixel(s) selected by the common electrode COMj and the segment electrode(s) SEGk. However, unselected LCD pixels are impressed with a small voltage between the fifth output voltage V4 and the fourth output voltage V3 or the sixth voltage V5. Normally, the number of unselected LCD pixels is exceedingly larger than the number of selected LCD pixels, both of which accompany power consumption as they are charged and discharged since LCD pixels can be considered as capacitive loads.

In this invention, the third output power supply voltage Vout3 generated by the third charge pump circuit CHP3 is used as the operating voltage of the fourth and fifth buffer circuits B3 and B4, respectively, to generate the fourth and fifth output voltages V3 and V4, respectively. The third output power supply voltage Vout3 is sufficiently higher than the required operating voltages of the fourth and fifth buffer circuits B3 and B4, respectively, and is exceedingly lower than conventional first output power supply voltage Vout1.

That is, the power consumption in the inventive power unit is determined by the product of the voltage Vout3 impressed on the buffer circuits and the currents that flow through the respective buffer circuits. It is noted that these currents that flow under the third output power supply voltage Vout3 are the same as the currents that flow under the conventional first output power supply voltage Vout1. In other words, these currents flow as the LCD pixels begin to discharge as capacitive loads from a predetermined voltage of one polarity until they are charged to a predetermined voltage of the opposite polarity. As a consequence, although the inventive power unit has a larger number of step-up circuits as compared with conventional power units, power consumption by the inventive power unit is less than that of conventional ones due to the fact that the power unit is powered by the low third output power supply voltage Vout3. In addition, since the operational amplifiers OP15, OP16, and OP17 as well as constant-current sources I15 and I16 and I17 are also operated at the low third output power supply voltage Vout3, the power consumption by these components is also reduced.

In even frames, selected common electrode COMj is supplied with the sixth voltage V5, while the unselected common electrodes COM1-COMn (excluding COMj) are supplied with the second output voltage V1 during scanning. On the other hand, segment electrodes SEG1-SEGm are supplied with the first output voltage V0 or the third output voltage V2, depending on the display signal supplied to the selected common electrode.

Thus, while a large voltage between the sixth voltage V5 and the first output voltage V0 or the third output voltage V2 is supplied to the LCD pixel(s) selected by the common electrode COMj and the segment electrode(s) SEGk, unselected LCD pixels are supplied with a small voltage between the second output voltage V1 and the first output voltage V0 or the third output voltage V2. Even under this condition, power consumption also takes place in charging and discharging of the capacitive LCD pixels.

In the first embodiment of the present invention, the first output power supply voltage Vout1 generated by the first charge pump circuit CHP1 is utilized to energize the first buffer circuit B0 generating the first output voltage V0. In addition, the first output voltage V0 is utilized as the high voltage to energize the second buffer circuit B1 generating the second output voltage V1, while the power supply voltage Vout2 generated from the first output voltage V0 by the second charge pump circuit CHP2 is utilized as the low voltage to energize the third buffer circuit B2 generating the third output voltage V2. The second output power supply voltage Vout2 is much lower than the voltages required by the second and third buffer circuits B1 and B2, respectively.

In the example shown herein, the power consumption rate of the power unit is given by the product of the voltage difference between the first output power supply voltage Vout1 and the second output power supply voltage Vout2 and the current that flows under this voltage difference. The magnitude of this current is the same if the applied voltage, which is presently the difference between the first output voltage Vout1 and the second output power supply voltage Vout2, were the first output power supply voltage Vout1 as conventional. It is this current that flows through the capacitive LCD pixels discharging from a predetermined voltage of a given polarity and charging to a predetermined voltage of the opposite polarity. Accordingly, less power is consumed in the inventive buffer circuits than in conventional ones, since the voltage supplied to the buffers is the difference between the first output voltage Vout1 and the second output power supply voltage Vout2, lower than the conventional voltage.

It should be remembered, however, that the first output voltage V0 is generated from the first output power supply voltage Vout1 by the first buffer circuit B0, so that some power is also consumed by the first buffer circuit B0. Nevertheless, the power consumption in the inventive buffer circuits is less than that of conventional circuits if this power consumption is taken into account.

Furthermore, the current that flows during charging and discharging of the capacitive LCD pixels flows into the capacitor C2 connected to the output end of the second charge pump circuit CHP2. As a consequence, the capacitor C2 is charged by the discharging LCD pixels, and the charged voltage is stepped up.

As the voltage of the capacitor C2 becomes higher than the predetermined output level (9 V) of the second output power supply voltage Vout2, the second charge pump circuit CHP2 performing step-down operation now seemingly performs a step-up operation. That is, in the second charge pump circuit CHP2, the second output power supply voltage Vout2 exceeding the predetermined output level thereof is stepped up by the MOS transistors Q33-Q31 and the capacitors C33-C31 as seen from FIG. 6. As a consequence of this step-up operation, the voltage across the first capacitor C31, or the first output voltage V0, is stepped up accordingly, thereby causing power to be fed back from the output end of the second charge pump circuit CHP2 to the input end thereof.

Since the first output voltage V0 is supplied to the selected LCD pixels irrespective of whether the frame is even or odd numbered, the first output voltage V0 rarely exceeds the predetermined level practically.

Because of the feedback of power from the output end of the second charge pump circuit CHP2 to the input end thereof, power consumption can be still reduced effectively in the invention.

The power consumption rate by the voltage amplifier A1 and the voltage dividing resistors R0-R4 is substantially the same as the conventional rate.

Thus, the power supply circuit in accordance with the first embodiment of the invention has a distinct circuit arrangement as described above, exhibiting a remarkably reduced overall power consumption rate as compared with conventional ones.

It would be understood that the high first output voltage V0 supplied to the second buffer circuit B1 and the third buffer circuit B2 may be replaced by the first output power supply voltage Vout1. In this case, the electric power unit is partly modified as shown in FIG. 1 by dashed lines.

Although reference has been made above only to an embodiment that utilizes five output voltages (i.e. first through fifth output voltages V0-V4 along with a sixth reference voltage V5), the number of output voltages may be increased or reduced as needed. Further, use of the electric power unit is not limited to LCD units as described above. But rather, it may be used equally well with other matrix-type display units.

Figure 10:
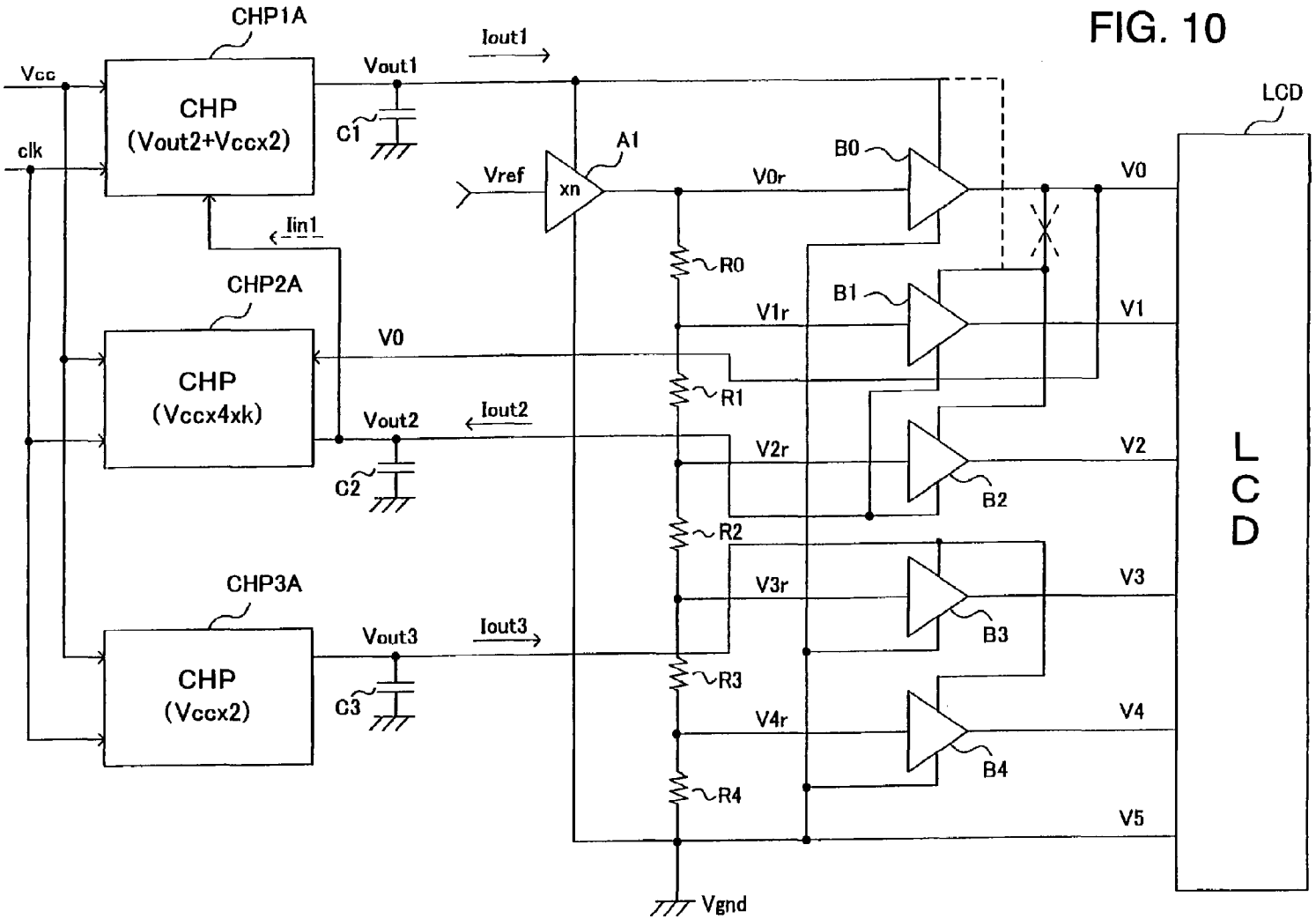
FIG. 10 is a circuit diagram of an electric power unit for driving an LCD unit in accordance with another embodiment of the invention.

FIG. 10 shows an electric power unit for driving an LCD unit in accordance with a second embodiment of the invention. FIGS. 11-14 show arrangements and operations of a first and a second charge pump circuits CHP1A and CHP2A, respectively, used as a first and a second voltage conversion circuits, respectively, of the power unit. Buffer circuits B0-B4 used in the second embodiment are the same in structure as those shown and described in connection with the first embodiment (FIGS. 2A-3B). A third charge pump circuit CHP3A serving as the third voltage conversion circuit is the same as the third charge pump circuit CHP3 of the first embodiment.

It is noted, however, that, unlike a conventional charge pump circuit CHP0 as shown in FIG. 15, the voltage conversion circuit of FIG. 10 has a first, a second, and a third charge pump circuits CHP1A-CHP3A, respectively. Moreover, the operating voltages of the first through fifth buffer circuits B0-B4 differ from those of FIG. 15. The rest of the circuit arrangement of the voltage conversion circuit is the same as that of FIG. 15.

The second charge pump circuit CHP2A is supplied with a power supply voltage Vcc (3 V) and a clock clk to perform charge pump operation, and, under a constant-voltage control described below, outputs a predetermined second constant output power supply voltage Vout2 (of 10.5 V for example) lower than the third output voltage V2 (12 V) but higher than the fourth output voltage V3 (3 V). The power supply voltage Vcc defines the level of the clock. For the constant-voltage control of the second charge pump circuit CHP2A to maintain the first output voltage V0 constant (15 V), the second output power supply voltage Vout2 of the charge pump circuit is controlled. The magnitude of the second output power supply voltage Vout2 turns out to be Vcc×4×k (where k is an arbitrary factor smaller than 1.0 to set Vout2 to a desired level, e.g. 10.5 V). Capacitor C2 is a smoothing capacitor.

The first charge pump circuit CHP1A is supplied with the second output power supply voltage Vout2 and steps up the second output supply voltage Vout2 through its charge pump operation before outputting it as the first output power supply voltage Vout1. The level of the first output power supply voltage Vout1 turns out to be Vout2+Vcc×2, since the second charge pump circuit is supplied with the second output power supply voltage Vout2 and doubly steps up the power supply voltage Vcc. Thus, the first output power supply voltage Vout1 becomes higher than the first output voltage V0 (15 V), which is 16.5V, for example. Capacitor C1 is a smoothing capacitor.

Figure 11:
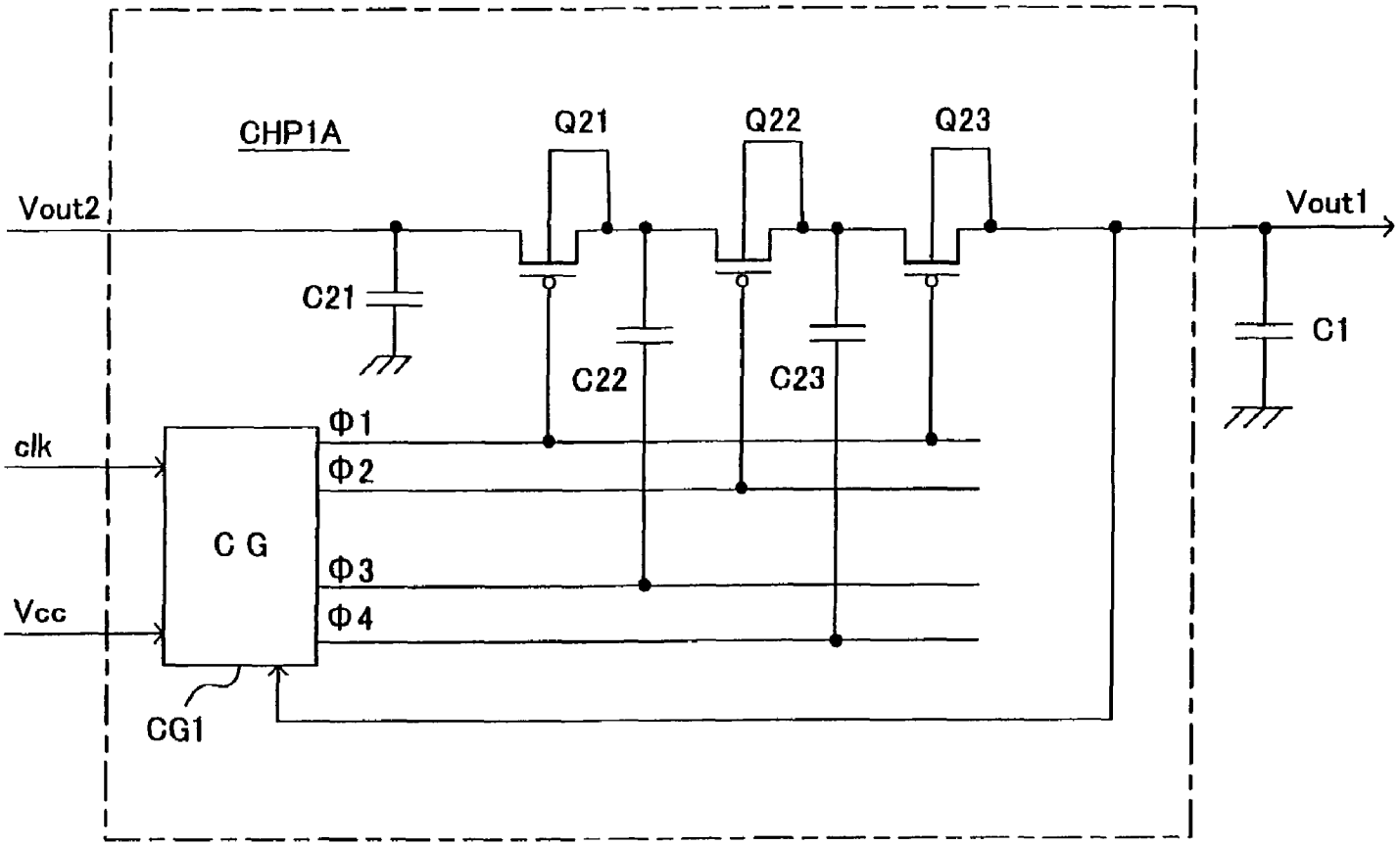
FIG. 11 is a circuit diagram of another first charge pump circuit CHP1A for use in the power unit according to the invention.
Figure 12:
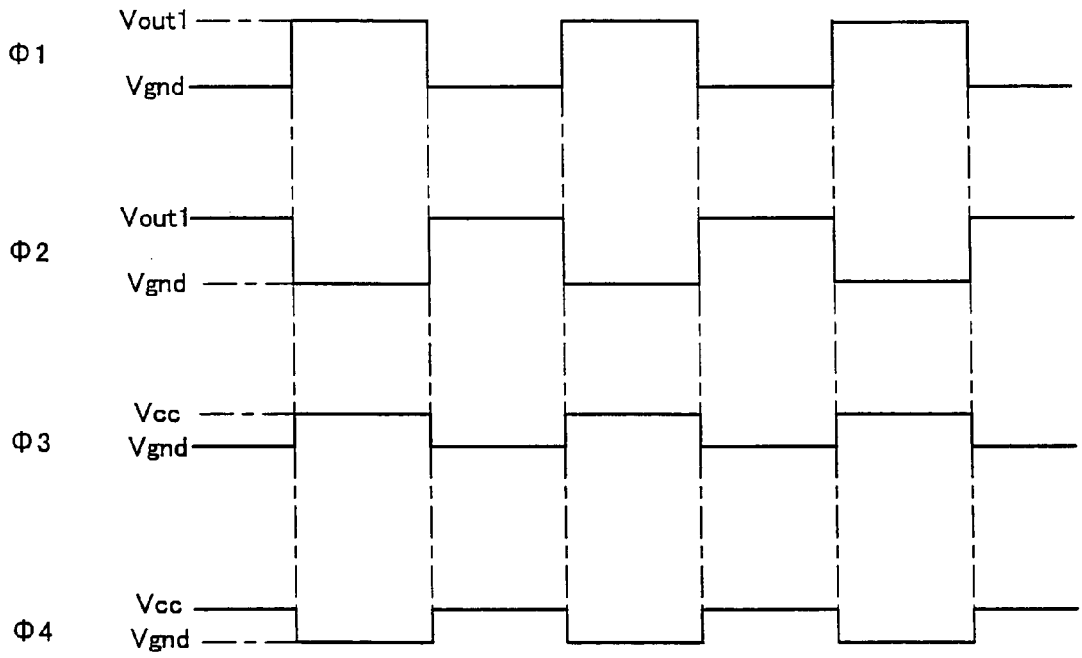
FIG. 12 is a graph showing the operation of the first charge pump circuit CHP1A.

FIGS. 11 and 12 respectively show the arrangement and operation of the first charge pump circuit CHP1A. As shown in FIG. 11, the first charge pump circuit CHP1A has a series of P-type MOS transistors Q21-Q23 which receive the second output power supply voltage Vout2 at the input end thereof. The charge pump circuit has capacitors C21-C23 each having one end connected to the input end of a corresponding one of the MOS transistors Q21-Q23. The capacitor C21 is grounded at the other end thereof, while the capacitors C22 and C23 are coupled at the other ends thereof with two-phase clocks ϕ3 and ϕ4. The charge pump circuit CHP1A provides at the output end thereof the first output power supply voltage Vout1 and a first output current Iout1 therefrom.

The clock signal clk, power supply voltage Vcc, and first output power supply voltage Vout1 are inputted to a clock generator CG1 to generate first through fourth clocks ϕ1-ϕ4. These clocks are synchronized as shown in FIG. 12. The first and second clocks ϕ1 and ϕ2, respectively, are complementary two-phase clocks, varying between the ground potential Vgnd and the first output power supply voltage Vout1. The first clock ϕ1 is supplied to the gates of the odd numbered MOS transistors Q21 and Q23 while the second clock ϕ2 is supplied to the gates of the even numbered MOS transistor Q22, thereby controlling ON-OFF operation of these transistors.

The third and fourth clocks ϕ3 and ϕ4, respectively, are also complementary two-phase clocks, varying between the ground potential Vgnd and the power supply voltage Vcc. The third clock ϕ3 is supplied to the other end of the even numbered capacitor C22, while the fourth clock ϕ4 is supplied to the other end of the odd numbered capacitor C23. The third and fourth clocks ϕ3 and ϕ4, respectively, have an amplitude (Vcc-Vgnd), which determines the step-up voltage of the respective charge pump units.

The first charge pump circuit CHP1A is supplied with the second output power supply voltage Vout2 as an input voltage thereto, which is stepped up by two units (2 Vcc). As a consequence, the first output power supply voltage Vout1 equals Vout2+Vcc×2.

Figure 13:
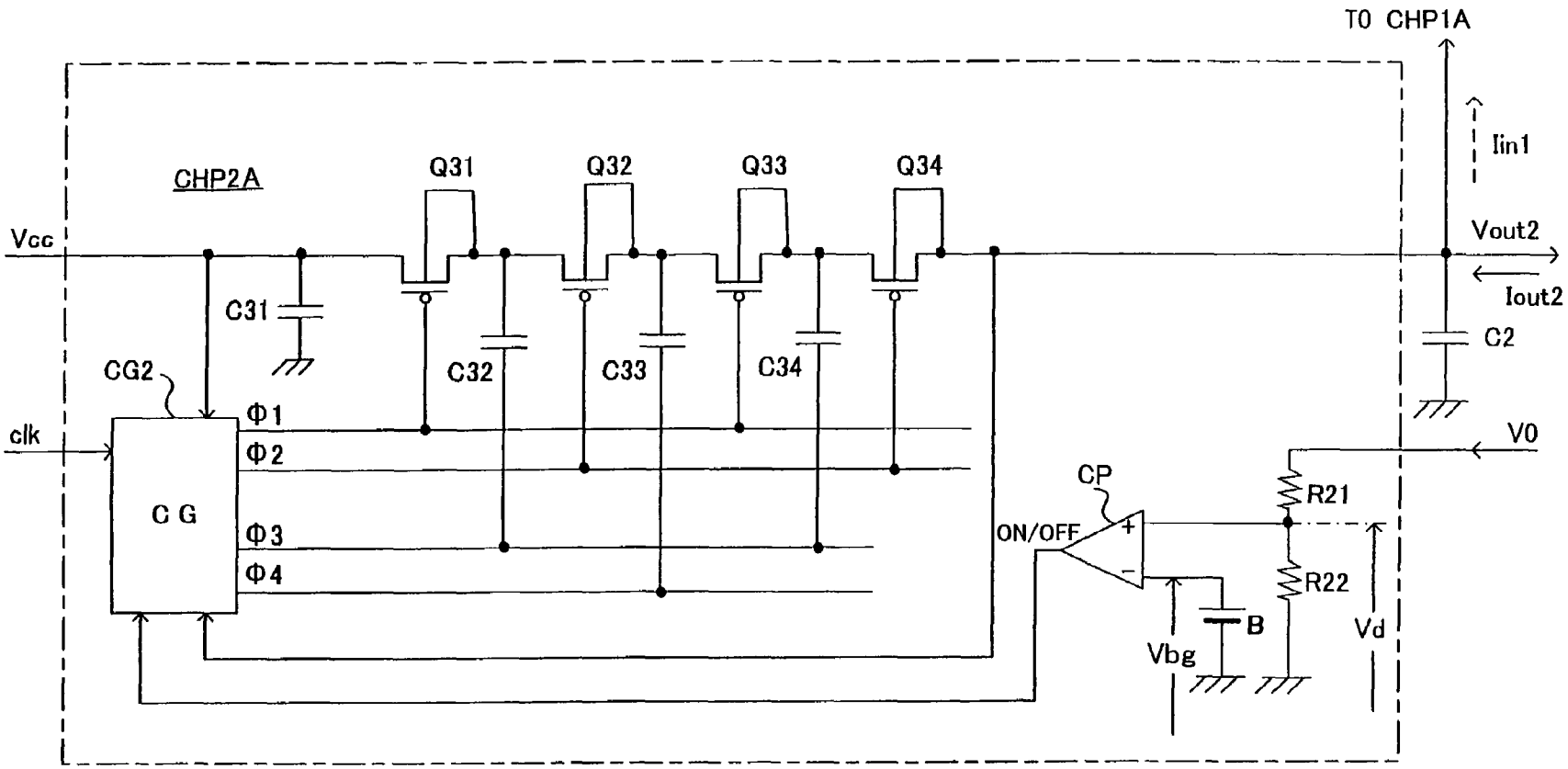
FIG. 13 is a circuit diagram of another second charge pump circuit CHP2A for use in the power unit according to the invention.
Figure 14:
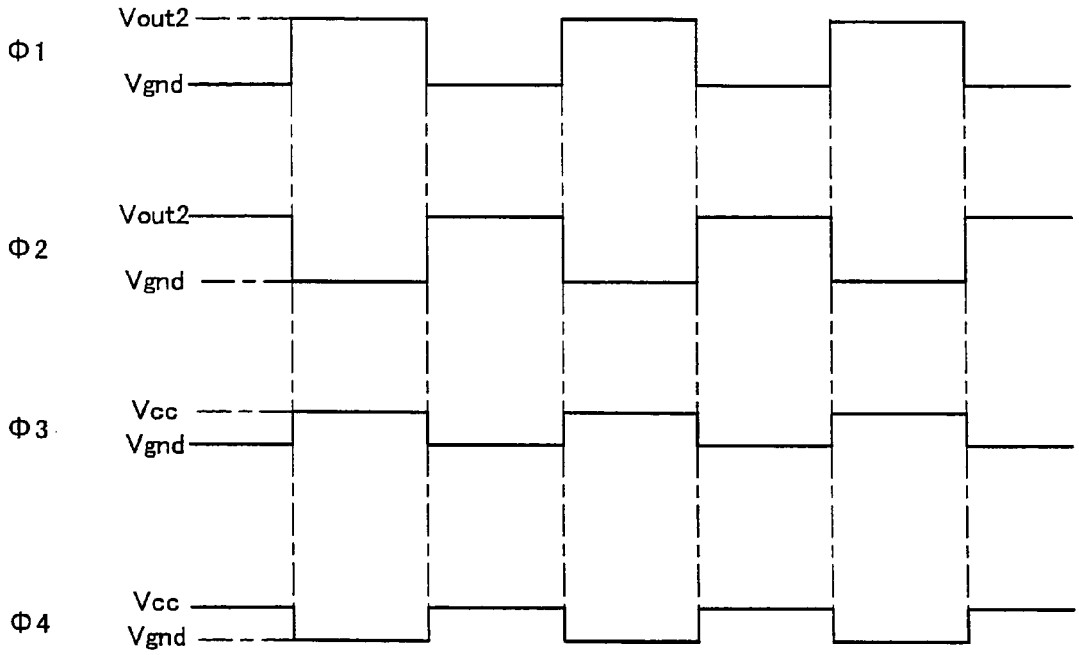
FIG. 14 is a graph showing the operation of the second charge pump circuit CHP2A.

FIGS. 13 and 14 respectively show the arrangement and operation of the second charge pump circuit CHP2A. As shown in FIG. 13, the second charge pump circuit CHP2A has a series of P-type MOS transistors Q31-Q34 that receives the power supply voltage Vcc at the input end thereof. The charge pump circuit has capacitors C31-C34 each having one end connected to the input end of a corresponding one of the MOS transistors Q31-Q34. The capacitor C31 is grounded at the other end thereof, while the capacitors C32-C34 are coupled at the other ends thereof with the two-phase clocks ϕ3 and ϕ4.

The second output power supply voltage Vout2 of the second charge pump circuit CHP2A is supplied to the second and third buffer circuits B1 and B2, respectively, as their operating voltages, and to the first charge pump circuit CHP1A as the input voltage thereto.

The clock generator CG2 of the first charge pump circuit is supplied with the clock signal clk, the power supply voltage Vcc for determining the magnitude of step-up voltage of the respective charge pump units, and the second output power supply voltage Vout2, and outputs synchronized clocks ϕ1-ϕ4 as shown in FIG. 14. The first and second clocks ϕ1 and ϕ2, respectively, are complementary two-phase clocks varying between the ground potential Vgnd and the second output power supply voltage Vout2. The first clock ϕ1 is supplied to the gates of the odd numbered MOS transistors Q31 and Q33 while the second clock ϕ2 is supplied to the gates of the even numbered MOS transistors Q32 and Q34, to control ON-OFF operation of these transistors.

The third and fourth clocks ϕ3 and ϕ4, respectively, are also complementary two-phase clocks varying between the ground potential Vgnd and the power supply voltage Vcc. The third clock ϕ3 is supplied to the other ends of the even numbered capacitors C32 and C34, while the fourth clock ϕ4 is supplied to the other end of the odd numbered capacitor C33. The third and fourth clocks ϕ3 and ϕ4, respectively, have an amplitude (Vcc-Vgnd), which determines the step-up voltage of the respective charge pump units.

While the second charge pump circuit CHP2A provides the second and third buffer circuits B1 and B2, respectively, with the second output power supply voltage Vout2 as the operating voltage thereof, the circuit receives the second output current Iout2 from the second and third buffer circuits B1 and B2, respectively. Most of the second output current Iout2 thus inputted is outputted as an input current Iin1 to the first charge pump circuit CHP1A (Iout2=Iin1).

That is, except for a start up period, little current flows into or out of the second charge pump circuit CHP2A while the circuit is normally providing power to the first charge pump circuit CHP1A and the second and third buffer circuits B1 and B2, respectively, based on the second output power supply voltage Vout2 as an operating voltage. Therefore, little power is consumed in the charge pump operation in the circuit.

The second charge pump circuit CHP2A performs its operation under the constant-voltage control as follows. The first output voltage V0 is fed back to the second charge pump circuit CHP2A, which is divided by resistors R21 and R22 to form a detection voltage Vd. On the other hand, a reference voltage Vbg is formed from a reference voltage source B by, for example, a band-gap type constant-voltage circuit. The detection voltage Vd and the reference voltage Vbg are compared in a comparator CP to provide the clock generator CG2 with a signal (referred to as comparison signal) indicative of the comparison. Thus, provision of clocks by the generator CG2 is controlled by the comparison signal received from the comparator CP.

This controlled provision of the clocks from the generator CG2 in turn causes the buffer B0 to accurately sustain the second output power supply voltage Vout2, the first output power supply voltage Vout1, and finally the first output voltage V0 at a predetermined level (15V). In this way, constant-voltage control of the buffer is attained through the feedback of the first output voltage V0.

The charge pump circuit CHP3A has the same arrangement as the charge pump circuit of the first embodiment shown in FIG. 8 and performs the same operation as shown in FIG. 9.

Referring to FIG. 16, operation of the electric power unit for driving an LCD unit in accordance with the second embodiment of the invention will now be described.

In odd frames, the first output voltage V0 is supplied to the common electrode COMj selected during scanning, and the fifth output voltage V4 is supplied to the unselected common electrodes COM1-COMn (excluding COMj). On the other hand, the fourth output voltage V3 or the sixth voltage V5 is supplied to the segment electrodes SEG1-SEGm, depending on the display signal associated with the selected common electrode.

A large voltage having a level between the first output voltage V0 and the fourth output voltage V3 or the sixth voltage V5 is applied to the LCD pixel(s) selected by the common electrode COMj and segment electrode(s) SEGk. However, unselected LCD pixels are supplied only with a small voltage between the fifth output voltage V4 and the fourth output voltage V3 or the sixth voltage V5. Since the number of unselected LCD pixels is normally far larger than that of selected LCD pixels and since LCD pixels can be regarded as capacitive loads, their charging and discharging accompany power consumption.

In the present invention, the third output power supply voltage Vout3 generated by the third charge pump circuit CHP3A is utilized as the voltage to energize the fourth buffer circuit B3 generating the fourth output voltage V3 and the fifth output voltage V4 generating the fifth buffer circuit B4. The third output power supply voltage Vout3 is sufficiently higher than the voltage required to drive the fourth buffer circuit B3 and the fifth buffer circuit B4, but much lower than the conventional first output power supply voltage Vout1.

That is, the power consumption in the inventive power unit is given by the product of the voltage Vout3 impressed on the buffer circuits and the currents that flow through the respective buffer circuits. These currents that flow under the third output power supply voltage Vout3 are the same as the currents that flow under the conventional first output power supply voltage Vout1. As the LCD pixels begin to discharge as capacitive loads from a predetermined voltage of one polarity, these currents flow until they are charged to a predetermined voltage of the opposite polarity. As a consequence, although step-up circuits increases in number as compared with conventional power units, power consumption by the inventive power unit is reduced to a lower level than that of conventional ones due to the fact that the power unit is powered by the low third output power supply voltage Vout3. In addition, since the operational amplifiers OP15, OP16, and OP17 as well as constant-current sources I15, I16 and I17 are also operated at the low third output power supply voltage Vout3, the power consumption by these components is also reduced accordingly.

In even frames, the selected common electrode COMj is supplied with the sixth voltage V5, while the unselected common electrodes COM1-COMn (excluding COMj) are supplied with the second output voltage V1 during scanning. On the other hand, segment electrodes SEG1-SEGm are supplied with the first output voltage V0 or the third output voltage V2 depending on the display signal supplied to the selected common electrode.

A large voltage between the sixth voltage V5 and the first output voltage V0 or the third output voltage V2 is supplied to the LCD pixel(s) selected by the common electrode COMj and segment electrode(s) SEGk. However, unselected LCD pixels are supplied with a smaller voltage between the second output voltage V1 and the first output voltage V0 or the third output voltage V2. Under this condition, power consumption also takes place in charging and discharging of the capacitive loads of LCD pixels.

In the second embodiment, the first output power supply voltage Vout1 is used as the voltage to energize the first buffer circuit B0 generating the first output voltage V0, where the first output power supply voltage Vout1 is obtained by stepping up the second output power supply voltage Vout2 by Vcc×2 in the first charge pump circuit CHP1A. In addition, the first output voltage V0 is used as the high voltage to energize the second buffer circuit B1 generating the second output voltage V1, while the second output power supply voltage Vout2 generated by the second charge pump circuit CHP2A is used as the low voltage to energize the third buffer circuit B2 generating the third output voltage V2.

The difference between the first output power supply voltage Vout1 and the second output power supply voltage Vout2 equals twice the power supply voltage Vcc (Vcc×2), which is sufficiently large to cover all the driving voltages of the first, second, and third buffers B0-B2, respectively.

Under this condition, the power consumption rate of the power unit is given by the product of the first output voltage applied and the current that flows between nodes of the first output power supply voltage Vout1 and the second output power supply voltage Vout2. The magnitude of this current is the same if the applied voltage, which is presently between the first output voltage V0 and the second output power supply voltage Vout2, were the first output power supply voltage Vout1 as conventional. This current flows through the capacitive loads of LCD pixels discharging from a predetermined voltage of a given polarity and being charged to a predetermined voltage of the opposite polarity.

Accordingly, the power consumption rates are the same for odd and even frames. The rates are equal to Iout×Vcc×2, where Iout is the current that flows from a node of the third output power supply voltage Vout3 or the first output power supply voltage Vout1.

It is noted that the current that flows during the charging and discharging of the capacitive loads of LCD pixels results in current Iout2 that flows into the capacitor C2 provided at the output end of the second charge pump circuit CHP2A. This current Iout2 that flows into the capacitor C2 flows into the first charge pump circuit CHP1A as the current Iin1 (Iout2=Iin1).

Accordingly, except for a startup period, the second charge pump circuit CHP2A provides the second output power supply voltage Vout2 as an operating voltage to the first charge pump circuit CHP1A and the second and third buffer circuits B1 and B2, respectively. That is, only negligible current flows into and out of the second charge pump circuit CHP2A, so that little power is consumed in the charge pump operation in the circuit.

Since the current that flows into the output end of the second charge pump circuit CHP2A flows into the first charge pump circuit CHP1A in this manner, further electric power is effectively saved in the second embodiment of the invention.

Power consumption in the voltage amplifier A1 and the voltage dividing resistors R0-R4 is the same as in the conventional circuit.

Thus, because of the distinct circuit arrangement of the electric power unit, which is clearly different from the conventional units, in accordance with the second embodiment of the invention as described above, the unit has a remarkably low overall power consumption rate as compared with conventional units.

The first output voltage V0 used as the operating voltage belonging to the high output voltage group for the second and third buffer circuits B1 and B2, respectively, may be replaced by the first output power supply voltage Vout1. In this case, the circuit arrangement is altered to one as shown in FIG. 10 by dashed lines.

The first output voltage V0 fed back to the second charge pump circuit CHP2A for constant-voltage control of the circuit may be replaced by the second output power supply voltage Vout2 or the first output power supply voltage Vout1.

Although the invention has been described above with reference to the first and second embodiments utilizing six intermediate step-up voltages (first through fifth output voltages V0-V4 plus sixth reference voltage V5), further intermediate voltages may be used as needed.

Although the electric power unit of the invention has been described for use with an LCD unit, it can be used as an electric power unit for other types of matrix-type displays.

What we claim is:

1. An electric power unit for driving a display unit, comprising:

a first voltage conversion circuit for stepping up an inputted power supply voltage to generate a first output power supply voltage;

a first multiplicity of buffer circuits for generating, based on said first output power supply voltage, a group of high output voltages that are lower than said first output power supply voltage;

a second multiplicity of buffer circuits for generating, based on a third output power supply voltage, a group of low output voltages;

a second voltage conversion circuit for stepping down the highest of said group of high output voltages to generate a second output power supply voltage that is lower than the lowest of said group of high output voltages but higher than the highest of said group of low output voltages; and a third voltage conversion circuit for stepping up said inputted power supply voltage to generate said third output power supply voltage that is lower than the lowest of said group of high output voltages but higher than the highest of said group of low output voltages, wherein each of said first through third output power supply voltages is provided as an operating voltage to at least one of said buffer circuits.

2. The electric power unit according to claim 1, wherein said buffer circuit outputting the highest of said group of high output voltages is energized by the first output power supply voltage;

at least other one of said first multiplicity of buffer circuits is energized by said first output power supply voltage or the highest of said group of high output voltages and by said second output power supply voltage; and at least one of said second multiplicity of buffer circuits is energized by said third output power supply voltage and a reference voltage.

3. The electric power unit for driving a display unit, comprising:

a first voltage conversion circuit for stepping up an inputted power supply voltage to generate a first output power supply voltage;

a second voltage conversion circuit for stepping down a highest output voltage of multiple voltages provided to the display unit wherein said first buffer circuit outputting said highest output voltage of said multiple output voltages is energized by said first output power supply voltage;

to generate a second output power supply voltage;

a third voltage conversion circuit for stepping up said inputted power supply voltage to generate a third output power supply voltage lower than said second output power supply voltage;

a first buffer circuit to which said first output power supply voltage is provided as its operating voltage;

a second buffer circuit to which said second output power supply voltage is provided as its operating voltage; and a third buffer circuit to which said third output power supply voltage is provided as its operating voltage.

4. The electric power unit according to claim 3, wherein said second buffer circuit outputting intermediate output voltage of said multiple output voltages is energized by said first output power supply voltage or said highest output voltage and by said second output power supply voltage, and said third buffer circuit outputting a lowest output voltage of said multiple output voltages is energized by said third output power supply voltage.

5. An electric power unit for driving a display unit, comprising:

a first voltage conversion circuit for stepping up an inputted power supply voltage to generate a first output power supply voltage;

a reference voltage generating circuit that generates a first reference voltage, a second reference voltage, a third reference voltage, a fourth reference voltage, and a fifth reference voltage based on said first output power supply voltage, said first through fifth reference voltages being lower than said first output power supply voltage;

a first buffer circuit receiving said first reference voltage to generate a first output voltage;

a second buffer circuit receiving said second reference voltage to generate a second output voltage;

a third buffer circuit receiving said third reference voltage to generate a third output voltage;

a fourth buffer circuit receiving said fourth reference voltage to generate a fourth output voltage;

a fifth buffer circuit receiving said fifth reference voltage to generate a fifth output voltage;

a second voltage conversion circuit receiving said first output voltage and stepping down said first output voltage to generate a second output power supply voltage lower than said third output voltage but higher than said fourth output voltage; and a third voltage conversion circuit for stepping up said inputted power supply voltage to generate a third output power supply voltage lower than said third output voltage but higher than said fourth output voltage, wherein said first buffer circuit is energized by said first output power supply voltage, said second buffer circuit is energized by one of said first output power supply voltage and said first output voltage as well as by said second output power supply voltage, said third buffer circuit is energized by said second output power supply voltage, said fourth buffer circuit is energized by said third output power supply voltage, and said fifth buffer circuit is energized by said third output power supply voltage.

6. The electric power unit according to claim 5, wherein said second voltage conversion circuit is a charge pump-type step-down circuit, while said first voltage conversion circuit and said third voltage conversion circuit are charge pump-type step-up circuits; and said second output power supply voltage is higher than said third output power supply voltage.

7. The electric power unit according to claim 6, wherein said first buffer circuit is provided with a first MOS transistor between nodes of said first output power supply voltage and said first output voltage, and a first operational amplifier receiving said first reference voltage and first output voltage to generate a control signal to said first MOS transistor;

said second buffer circuit is provided with a second MOS transistor and a third transistor connected in series between nodes of said first output power supply voltage or first output voltage and said second output power supply voltage, and providing at the node of said second and third MOS transistors said second output voltage, a second operational amplifier receiving said second reference voltage and second output voltage and outputting a control signal to said second MOS transistor, and a third operational amplifier receiving said second reference voltage and second output voltage, and outputting a control signal to said third MOS transistor;

said third buffer circuit is provided with a fourth MOS transistor connected between nodes of said third output voltage and second output power supply voltage, and a fourth operational amplifier receiving said third reference voltage and third output voltage and outputting a control signal to said fourth MOS transistor;

said fourth buffer circuit is provided with a fifth MOS transistor connected between nodes of said third output power supply voltage and fourth output voltage, and a fifth operational amplifier receiving said fourth reference voltage and fourth output voltage and outputting a control signal to said fifth MOS transistor, said fifth buffer circuit is provided with a sixth MOS transistor and a seventh transistor connected in series between nodes of said third output power supply voltage and sixth voltage and outputting at the node of said MOS transistors and said fifth output voltage, a sixth operational amplifier receiving said fifth reference voltage and fifth output voltage and outputting a control signal to said sixth MOS transistor, and a seventh operational amplifier receiving said fifth reference voltage and fifth output voltage and outputting a control signal to said seventh MOS transistor.

8. A display unit, comprising:

a matrix-type display panel;

a common driver for providing a drive voltage to the common electrodes of said display panel;

a segment driver for providing a signal voltage to the segment electrodes of said display panel; and an electric power unit for driving said common driver and segment driver, wherein said electric power unit includes:

a first voltage conversion circuit for stepping up an inputted power supply voltage to generate a first output power supply voltage, a first multiplicity of buffer circuits for generating, based on said first output power supply voltage, a group of high output voltages, and a second multiplicity of buffer circuits for generating, based on a third output power supply voltage, a group of low output voltages, each of said high output voltages and low output voltages being lower than said first output power supply voltage;

a second voltage conversion circuit for stepping down the highest of said group of high output voltages to output a second output power supply voltage lower than the lowest of said group of high output voltages but higher than the highest of said group of low output voltages; and a third voltage conversion circuit for stepping up said inputted power supply voltage to output said third output power supply voltage lower than the lowest of said group of high output voltages but higher than the highest of said group of low output voltages, wherein one of said first multiplicity of buffer circuits outputting the highest of said group of high output voltages is energized by said first output power supply voltage, at least other one of said first multiplicity of buffer circuits is energized by one of said first output power supply voltage and the highest of said group of high output voltages as well as by said second output power supply voltage; and at least one of said second multiplicity of buffer circuits is energized by said third output power supply voltage.

* * * * *